US012617500B2

(12) United States Patent
An

(10) Patent No.: US 12,617,500 B2
(45) Date of Patent: May 5, 2026

(54) ROLLING REDUCTION BOAT

(71) Applicant: Seong Su An, Busan (KR)

(72) Inventor: Seong Su An, Busan (KR)

( * ) Notice: Subject to any disclaimer, the term of this patent is extended or adjusted under 35 U.S.C. 154(b) by 394 days.

(21) Appl. No.: 18/280,189

(22) PCT Filed: Jan. 10, 2022

(86) PCT No.: PCT/KR2022/000361

§ 371 (c)(1),
(2) Date: Sep. 1, 2023

(87) PCT Pub. No.: WO2022/196911

PCT Pub. Date: Sep. 22, 2022

(65) Prior Publication Data

US 2024/0149990 A1 May 9, 2024

(30) Foreign Application Priority Data

Mar. 16, 2021 (KR) ..... 10-2021-0033761

(51) Int. Cl.
*B63B 43/06* (2006.01)
*B63B 27/14* (2006.01)
*B63B 39/00* (2006.01)

(52) U.S. Cl.
CPC ..... *B63B 43/06* (2013.01); *B63B 27/146* (2013.01); *B63B 39/00* (2013.01)

(58) Field of Classification Search
CPC ..... B63B 39/00; B63B 39/02; B63B 39/03; B63B 43/00; B63B 43/02; B63B 43/04; B63B 43/06; B63B 27/146
USPC ..... 114/121, 122, 124, 125
See application file for complete search history.

(56) References Cited

U.S. PATENT DOCUMENTS 3,678,877 A * 7/1972 Csupor ..... B63B 39/03 114/125
6,167,829 B1 * 1/2001 Lang ..... B63B 1/38 114/61.12
8,056,496 B1 11/2011 Bussa
9,120,542 B2 * 9/2015 Choisnet ..... B63B 39/00
(Continued)

FOREIGN PATENT DOCUMENTS

CN 202953147 U 5/2013
EP 2042426 A1 4/2009
(Continued)

*Primary Examiner* — Daniel V Venne
(74) *Attorney, Agent, or Firm* — KORUS Patent, LLC; Seong Il Jeong

(57) ABSTRACT

The present disclosure relates to a rolling reduction boat, and more particularly, to a rolling reduction boat having a structure that allows a rolling reduction tube, which is formed to surround a boat main body, to be filled with water. The present disclosure has the following advantageous effects. That is, according to the present disclosure, by filling a rolling reduction tube, which surrounds a boat main body, with water, there are advantages that the overall weight of the boat is increased, and the center of mass is moved downward and distributed, thus making it easy to get on the boat even in water, and the degree to which the boat tilts or rolls due to external factors such as a strong wind, a wave, and a change in the position of a passenger is reduced and a restoring force of the boat is increased, thus making it possible to more safely sail the boat.

3 Claims, 9 Drawing Sheets

(56) References Cited

U.S. PATENT DOCUMENTS

| | | | | |
|---|---|---|---|---|
| 9,605,398 | B2 * | 3/2017 | Snellman | B63B 39/03 |
| 2017/0305509 | A1 | 10/2017 | Sporing | |

FOREIGN PATENT DOCUMENTS

| | | | |
|---|---|---|---|
| JP | 2003-285790 | A | 10/2003 |
| KR | 20-0261789 | Y1 | 1/2002 |
| KR | 10-2012-0017940 | A | 2/2012 |
| KR | 10-2090815 | B1 | 4/2020 |

* cited by examiner (b)

(c)

ROLLING REDUCTION BOAT

TECHNICAL FIELD

The present disclosure relates to a boat having a rolling reduction function that reduces rolling and makes it very easy to get on the boat in water, and more particularly, to a rolling reduction boat having a structure that allows a rolling reduction tube, which surrounds a boat main body, to be filled with water during sailing of the boat.

BACKGROUND ART

Generally, small and medium-sized boats such as yachts, fishing boats, and coastal fishing boats have advantages that transportation and storage are convenient and costs are inexpensive due to their small sizes.

However, there are disadvantages that it is actually impossible to get on the boat again after falling into the water, the boat may tilt or roll due to external factors such as a strong wind, a wave, and a change in the position of a passenger, and in severe cases, the risk of capsizing is high.

In order to address such problems, techniques and methods for attaching an auxiliary device for adding buoyancy to the hull have been developed, but there are problems that tasks of assembling and disassembling the auxiliary device are complicated, for example, the auxiliary device should be assembled or installed in advance on land before sailing and should be disassembled and separately stored when not sailing, and the structure is not satisfactory.

Accordingly, the present applicant has conducted research on and developed a rolling reduction boat configured to allow a rolling reduction tube to be filled with water at any time, in water before getting on the boat and even after getting on the boat, thus preventing tilting, rolling, and capsizing of the boat.

DISCLOSURE

Technical Problem

The present disclosure is directed to providing a rolling reduction boat configured to allow a rolling reduction tube, formed to surround a boat main body, to be filled with water during sailing of the boat, thus making it easy to get on the boat in water and preventing tilting, rolling, and capsizing of the boat.

Technical Solution

The present disclosure proposes a rolling reduction boat including: a boat main body (100); rolling reduction tubes (200, 200') formed to surround a side portion of the boat main body (100); a tube connection member (300) coupled to communicate with front end openings of the rolling reduction tubes (200, 200') and having a water injection hole (310), through which water is injected, formed to pass through an upper side; a water injection member (400) formed at a lower portion of a front side of the boat main body (100) to inject water into the water injection hole (310), having a plate shape, extending forward, having a bendable material, and configured to submerge in water when the boat main body (100) is disposed on water; a coupling protrusion (500) formed on an upper portion of the front side of the boat main body (100) and configured to protrude forward; an extension member (600) configured to extend vertically downward from a lower end of the front side of the boat main body (100) and submerge in water when the boat main body (100) is disposed on water; a pitching prevention member (700) formed on a lower end portion of the extension member (600) and formed to be dustpan-shaped with an open front surface and an open upper surface; and a rope ladder (800) formed at a rear side of the boat main body (100), wherein the rolling reduction tubes (200, 200') include opening maintenance members (210, 210') formed to surround the front end openings of the rolling reduction tubes (200, 200') to maintain an open state of the rolling reduction tubes (200, 200'), the tube connection member (300) includes a water injection guide member (320) formed at an inner lower side of the tube connection member (300), formed in a curved shape that is convex upward, and configured to guide water, injected into the tube connection member (300) through the water injection hole (310), to flow downward into the rolling reduction tubes (200, 200'), and the water injection member (400) includes a coupling hole (410) formed to vertically pass through a front end of the water injection member (400) and configured to be coupled to the coupling protrusion (500) when the water injection member (400) is rolled upward.

Advantageous Effects

According to the present disclosure, by filling a rolling reduction tube, which surrounds a boat main body, with water during sailing of the boat, there are advantages that the overall weight of the boat is increased, and the center of mass is moved downward and distributed, thus making it easy to get on the boat even after falling into the water, and the degree to which the boat tilts or rolls due to external factors such as a strong wind, a wave, and a change in the position of a passenger is reduced and a restoring force of the boat is increased, thus making it possible to safely get on the boat again even after falling into the water and sail the boat.

BEST MODE OF THE INVENTION

Figure 1:
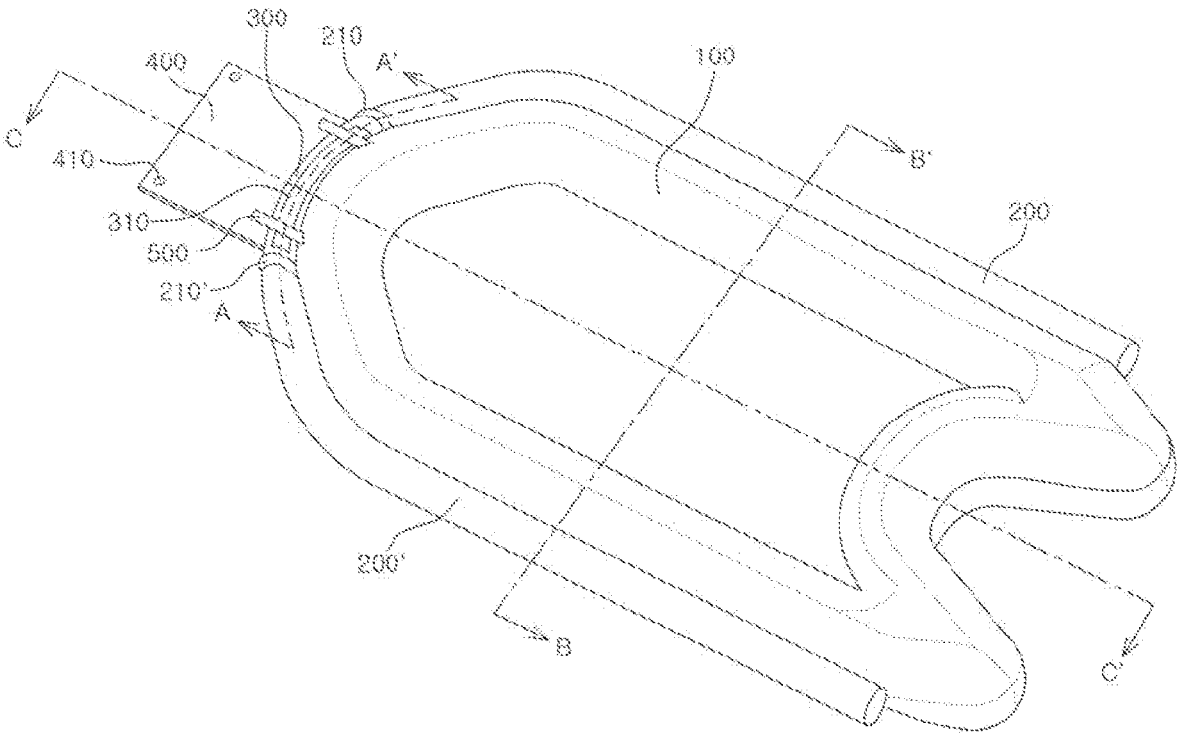
FIGS. 1 to 3 are perspective views of a rolling reduction boat according to the present disclosure.

The best mode of an inflatable rescue boat for carrying out the disclosure is proposed in a form including: a boat main body 100; rolling reduction tubes 200 and 200' formed to surround a side portion of the boat main body 100; a tube connection member 300 coupled to communicate with front end openings of the rolling reduction tubes 200 and 200' and having a water injection hole 310, through which water is injected, formed to pass through an upper side; a water injection member 400 formed at a lower portion of a front side of the boat main body 100 to inject water into the water injection hole 310, having a plate shape, extending forward, having a bendable material, and configured to submerge in water when the boat main body 100 is disposed on water; a coupling protrusion 500 formed on an upper portion of the front side of the boat main body 100 and configured to protrude forward; an extension member 600 configured to extend vertically downward from a lower end of the front side of the boat main body 100 and submerge in water when the boat main body 100 is disposed on water; a pitching prevention member 700 formed on a lower end portion of the extension member 600 and formed to be dustpan-shaped with an open front surface and an open upper surface; and a rope ladder 800 formed at a rear side of the boat main body 100, wherein the rolling reduction tubes 200 and 200' include opening maintenance members 210 and 210' formed to surround the front end openings of the rolling reduction tubes 200 and 200' to maintain an open state of the rolling reduction tubes 200 and 200', the tube connection member 300 includes a water injection guide member 320 formed at an inner lower side of the tube connection member 300, formed in a curved shape that is convex upward, and configured to guide water, injected into the tube connection member 300 through the water injection hole 310, to flow downward into the rolling reduction tubes 200 and 200', and the water injection member 400 includes a coupling hole 410 formed to vertically pass through a front end of the water injection member 400 and configured to be coupled to the coupling protrusion 500 when the water injection member 400 is rolled upward.

Modes of the Invention

Hereinafter, exemplary embodiments of the present disclosure will be described based on the accompanying drawings. However, the scope of rights of the present disclosure should be identified by the claims. Also, description of known art that may unnecessarily obscure the gist of the present disclosure will be omitted.

However, because the sizes and thicknesses of components shown in the drawings are arbitrarily shown for convenience of description, the present disclosure is not necessarily limited to those illustrated in the drawings, and thicknesses may have been exaggerated to clearly express various portions and areas.

In the description of the present disclosure, "front side" and "front" refer to the bow side and a direction toward the bow based on the center of the hull, and "rear side" and "rear" refer to the stern side and a direction toward the stern based on the center of the hull.

Also, in the description of the present disclosure, directions such as "upward" and "downward" are only indicated based on the form of FIG. 1 to assist understanding, and it should be noted that the directions may be differently indicated when the reference line (or drawing) changes.

The present disclosure relates to a rolling reduction boat, and more particularly, to a rolling reduction boat having a structure that allows a rolling reduction tube, which is formed to surround a boat main body, to be filled with water during sailing of the boat.

Figure 2:
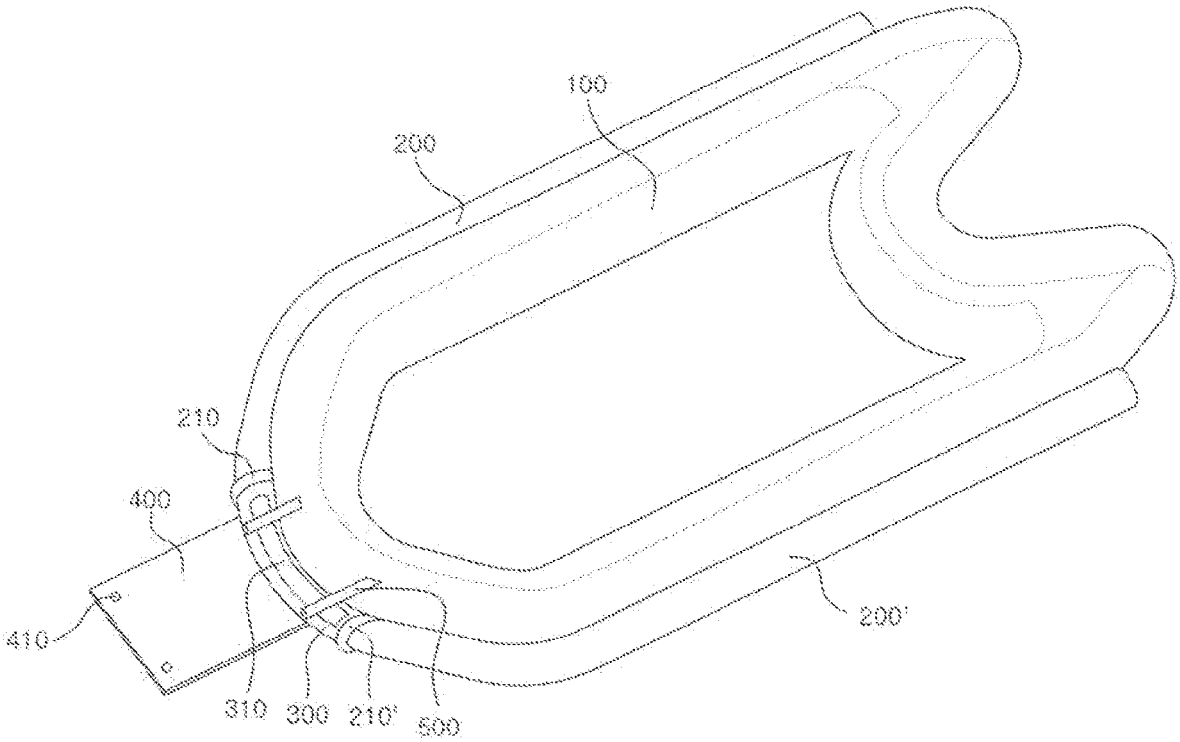
Figure 3:
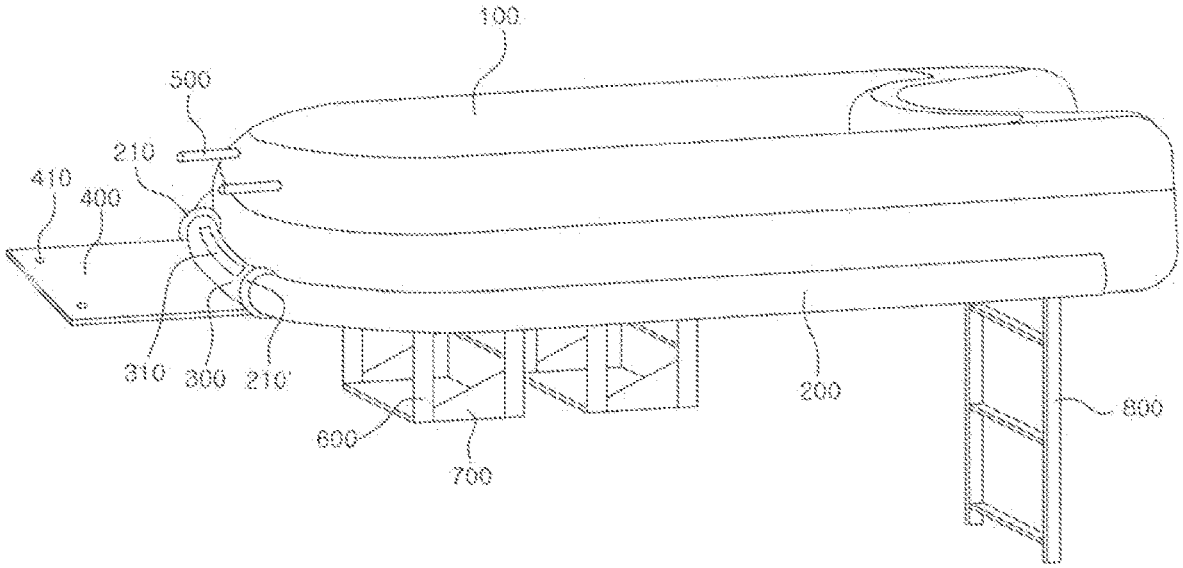
Figure 4:
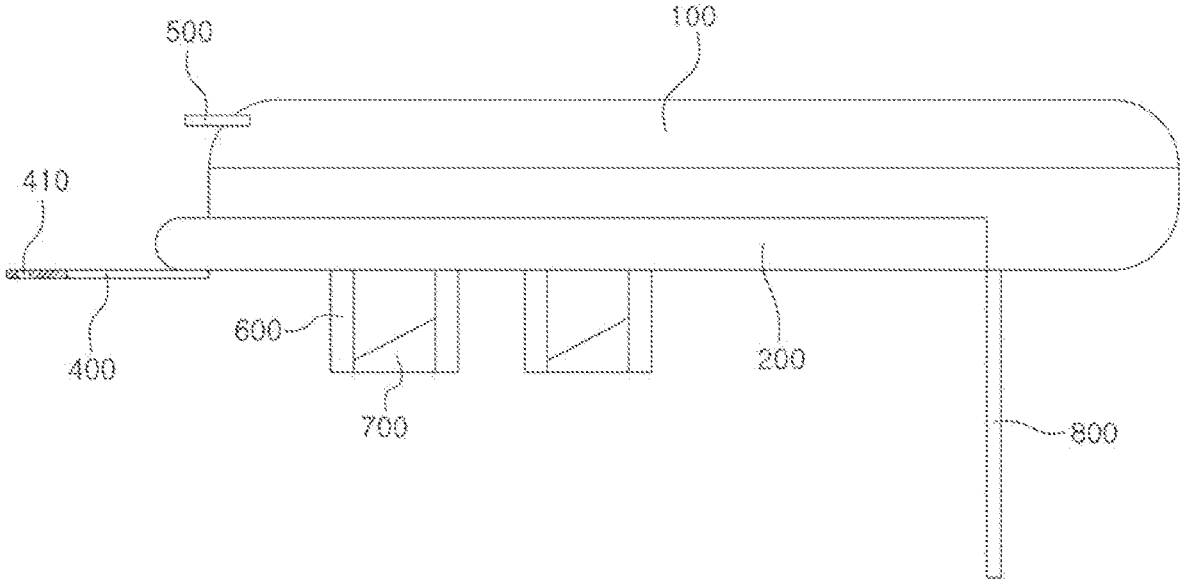
FIG. 4 is a lateral view of the rolling reduction boat according to the present disclosure and shows a state before a water injection member is coupled to a coupling protrusion.
Figure 5:
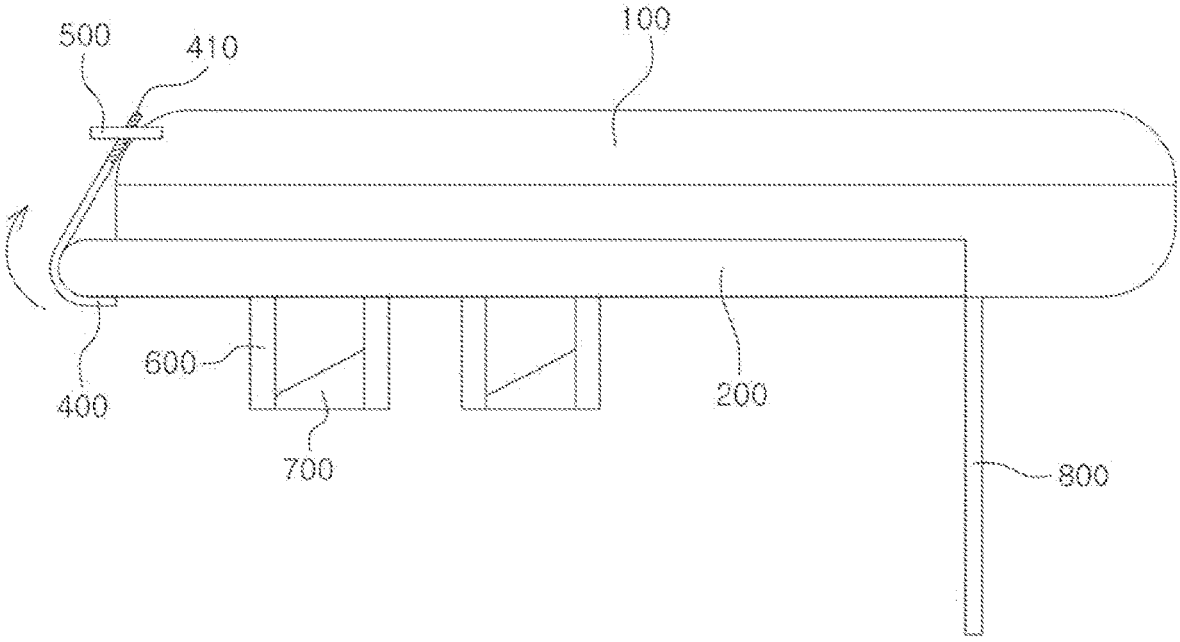
FIG. 5 is a lateral view of the rolling reduction boat according to the present disclosure and shows a state after the water injection member is coupled to the coupling protrusion.
Figure 6:
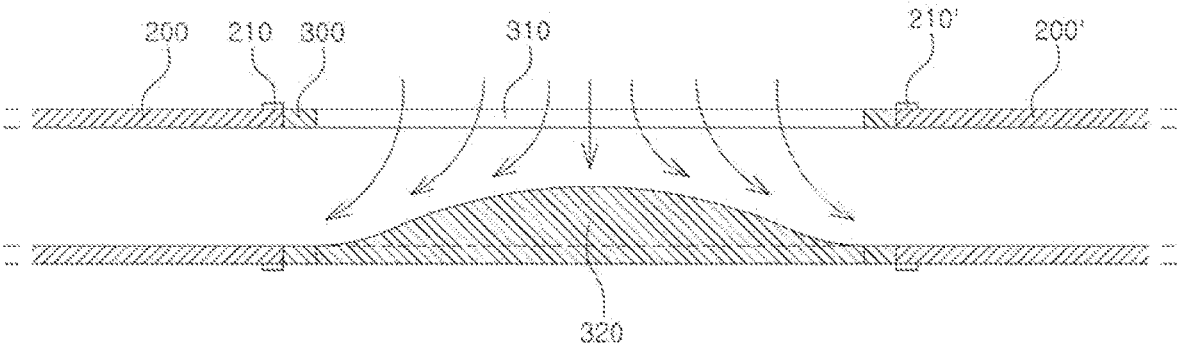
FIG. 6 is a cross-sectional view along line A-A' of FIG. 1.
Figure 7A:
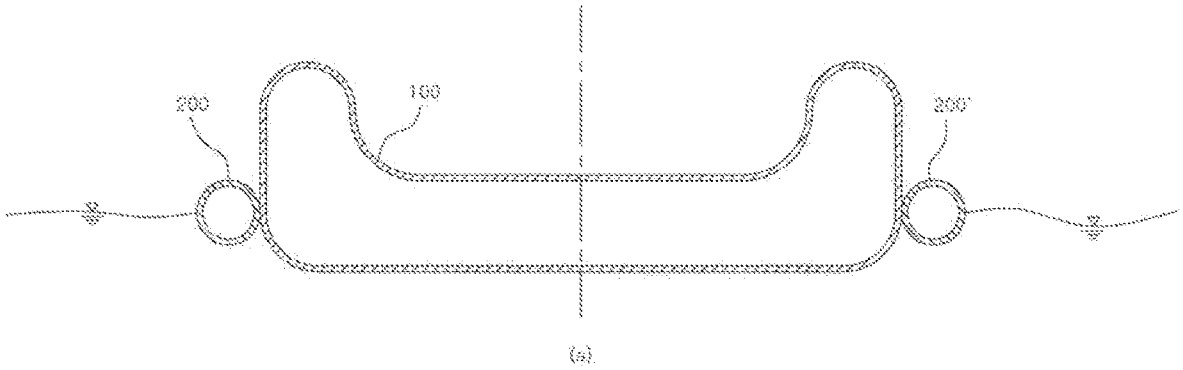
FIGS. 7A to 7C are cross-sectional views along line B-B' of FIG. 1 and show a state in which a rolling reduction tube is not filled with water.
Figure 7B:
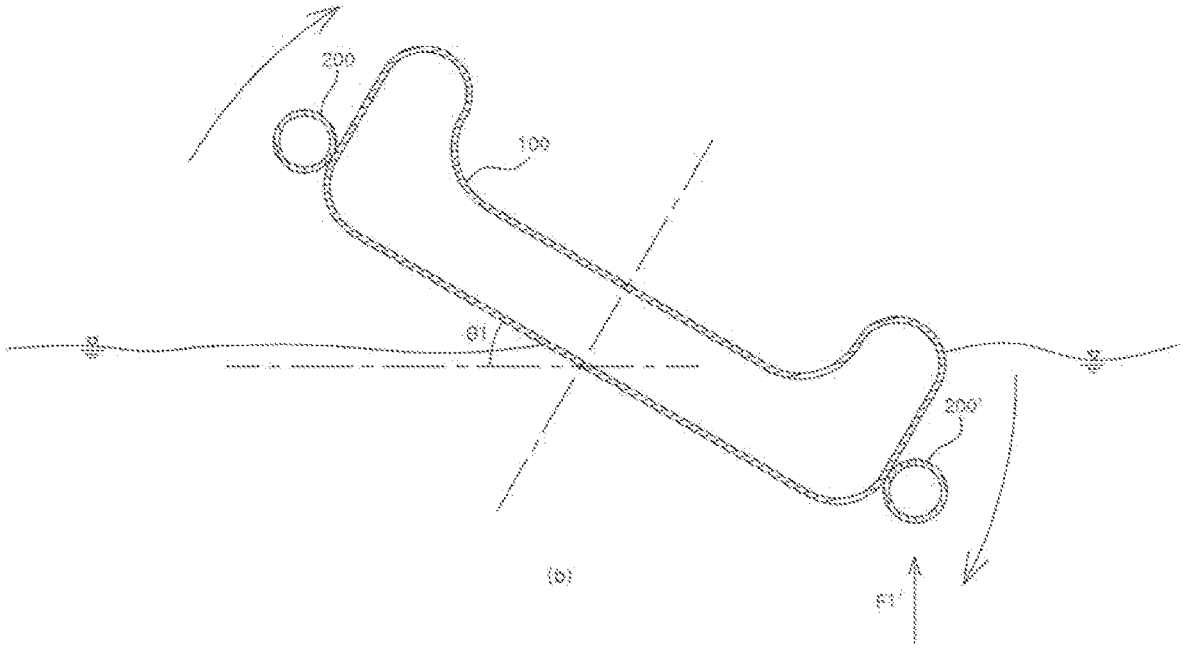
Figure 7C:
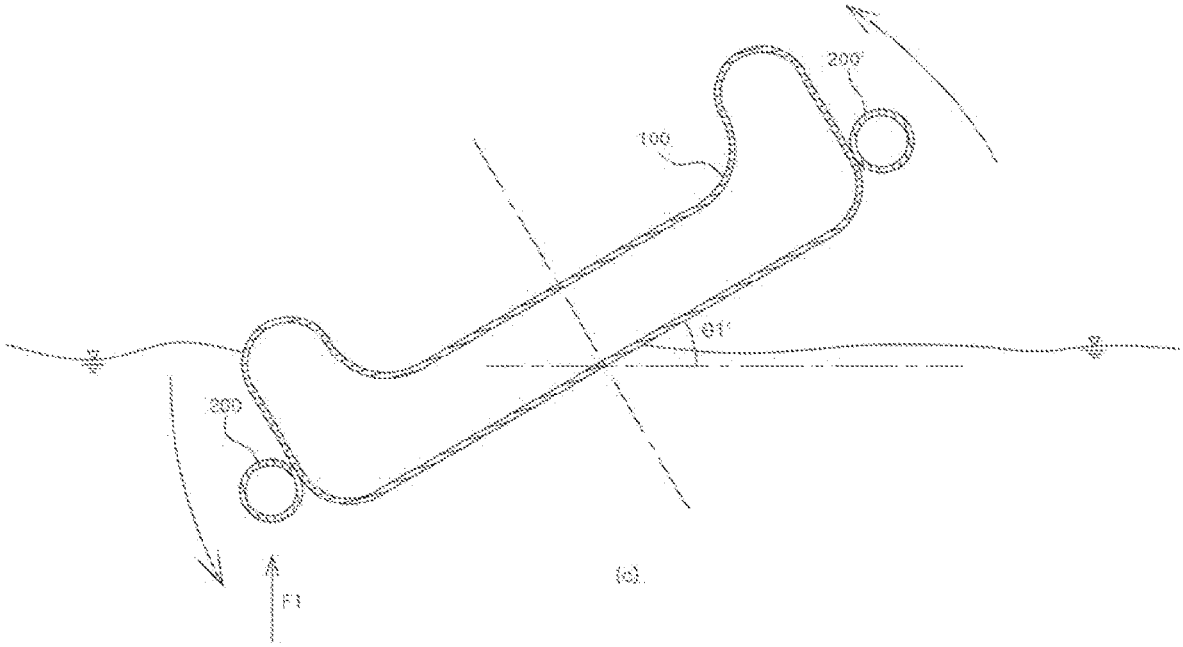
Figure 8A:
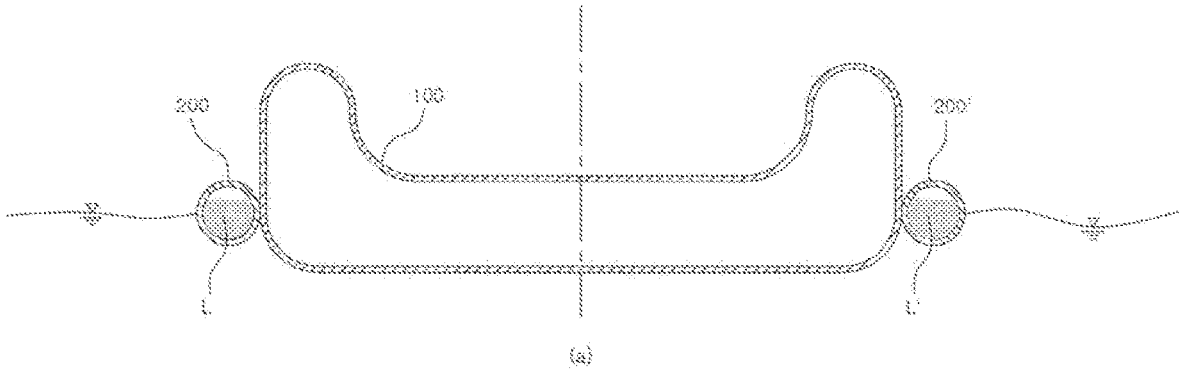
FIGS. 8A to 8C are cross-sectional views along line B-B' of FIG. 1 and show a state in which the rolling reduction tube is filled with water.
Figure 8B:
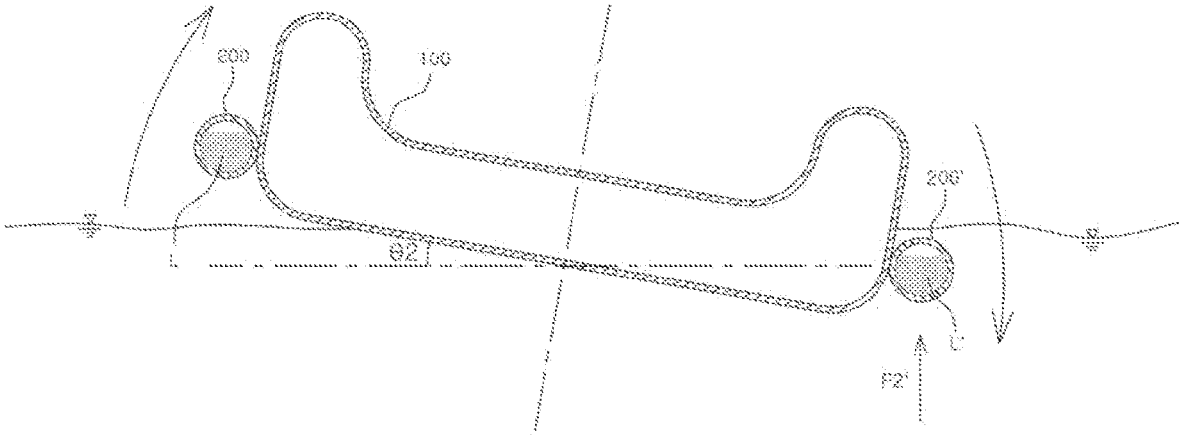
Figure 8C:
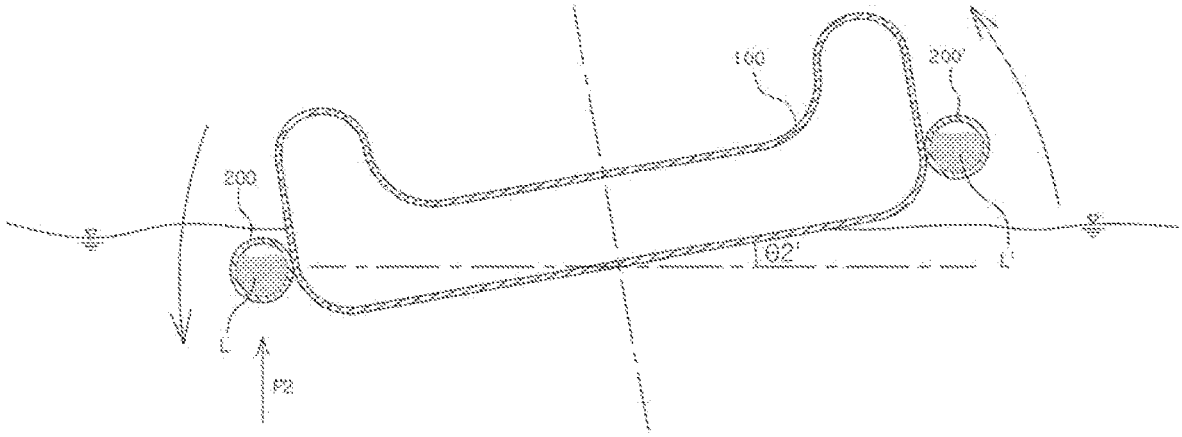
Figure 9:
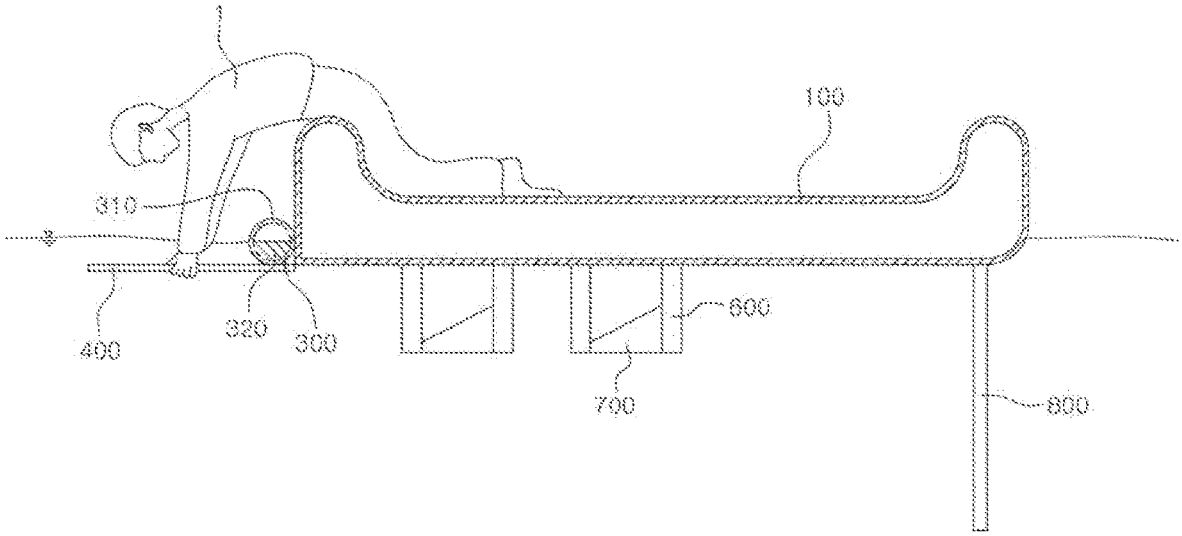
FIG. 9 is a cross-sectional view along line C-C' of FIG. 1 and shows a state before a passenger scoops and pours water using a water injection member.
Figure 10:
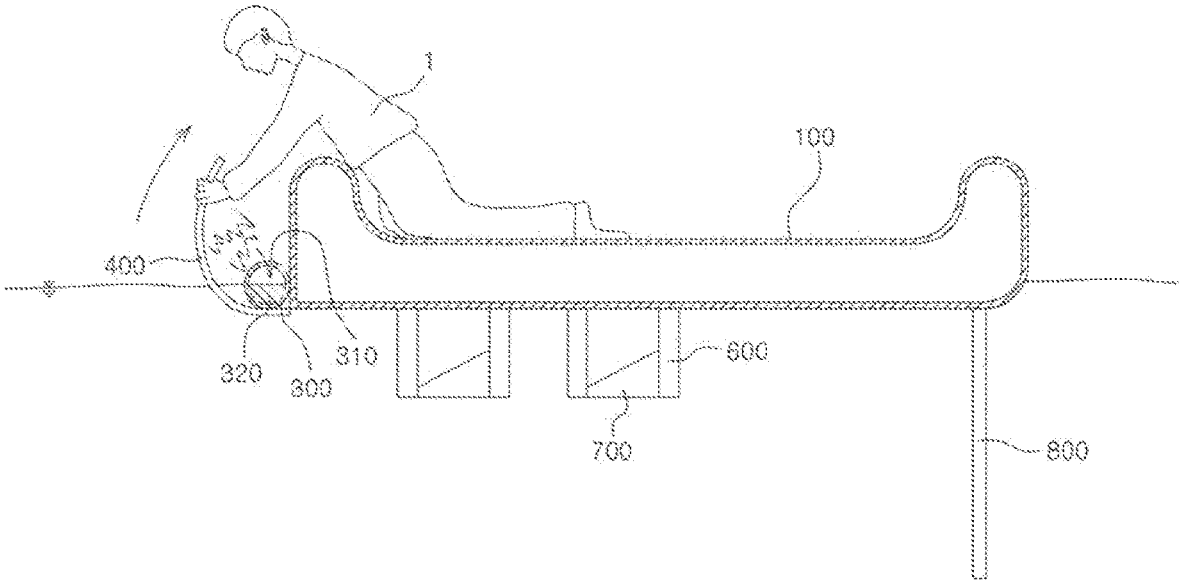
FIG. 10 is a cross-sectional view along line C-C' of FIG. 1 and shows a state in which the passenger scoops and pours water using the water injection member.
Figure 11:
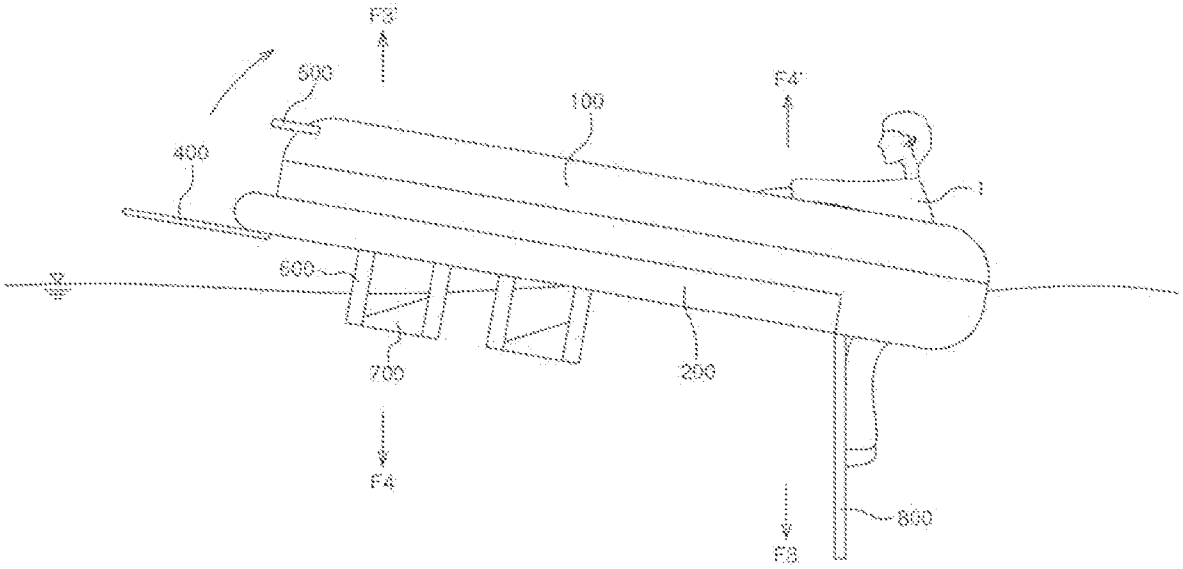
FIG. 11 is a lateral view of the rolling reduction boat according to the present disclosure and shows a state in which the passenger gets on the boat using a rope ladder.

FIGS. 1 to 3 are perspective views of a rolling reduction boat according to the present disclosure, FIG. 4 is a lateral view of the rolling reduction boat according to the present disclosure and shows a state before a water injection member is coupled to a coupling protrusion, FIG. 5 is a lateral view of the rolling reduction boat according to the present disclosure and shows a state after the water injection member is coupled to the coupling protrusion, FIG. 6 is a cross-sectional view along line A-A' of FIG. 1, FIGS. 7A to 7C are cross-sectional views along line B-B' of FIG. 1 and show a state in which a rolling reduction tube is not filled with water, FIGS. 8A to 8C are cross-sectional views along line B-B' of FIG. 1 and show a state in which the rolling reduction tube is filled with water, FIG. 9 is a cross-sectional view along line C-C' of FIG. 1 and shows a state before a passenger scoops and pours water using a water injection member, FIG. 10 is a cross-sectional view along line C-C' of FIG. 1 and shows a state in which the passenger scoops and pours water using the water injection member, and FIG. 11 is a lateral view of the rolling reduction boat according to the present disclosure and shows a state in which the passenger gets on the boat using a rope ladder.

As illustrated in FIGS. 1 to 3, a rolling reduction boat according to the present disclosure may be configured by including a boat main body 100, rolling reduction tubes 200 and 200', a tube connection member 300, a water injection member 400, a coupling protrusion 500, an extension member 600, a pitching prevention member 700, and a rope ladder 800.

The rolling reduction tubes 200 and 200' will be described. The rolling reduction tubes 200 and 200' are portions formed to surround a side portion of the boat main body 100 and are portions filled with water to prevent rolling of the boat main body 100.

In other words, as the rolling reduction tubes 200 and 200' are filled with water, the degree to which the boat main body 100 tilts or rolls is reduced, and a restoring force of the boat is increased.

The rolling reduction tubes 200 and 200' may be configured by including opening maintenance members 210 and 210' formed to surround front end openings of the rolling reduction tubes 200 and 200' to maintain an open state of the rolling reduction tubes 200 and 200'.

When the rolling reduction tubes 200 and 200' are formed of a rubber material, the open front ends thereof may be rolled inward, and in this case, it is difficult for water to be injected into the rolling reduction tubes 200 and 200'. Therefore, the opening maintenance members 210 and 210' are used to maintain the rolling reduction tubes 200 and 200' in an open state.

A state in which the rolling reduction tubes 200 and 200' are not filled with water L is illustrated in FIGS. 7A to 7C. That is, referring to FIGS. 7A to 7C, when the rolling reduction tubes 200 and 200' are not filled with the water L, the degree to which the boat main body 100 is rolled is high, and the boat main body 100 is tilted by as much as θ1 and θ1'.

This is because, when the rolling reduction tubes 200 and 200' are not filled with the water L, the overall weight of the boat is small, and buoyant forces F1 and F1' of portions submerged in water during rolling of the boat main body 100 are not large, such that a restoring force of the boat main body 100 is small.

Conversely, a state in which the rolling reduction tubes 200 and 200' are filled with the water L is illustrated in FIGS. 8A to 8C. That is, referring to FIGS. 8A to 8C, when the rolling reduction tubes 200 and 200' are filled with the water L, the degree to which the boat main body 100 is rolled is relatively low, and thus the boat main body 100 is tilted only by as much as θ2 and θ2'.

This is because, when the rolling reduction tubes 200 and 200' are filled with the water L, the overall weight of the boat is relatively large, and buoyant forces F2 and F2' of the portions submerged in water during rolling of the boat main body 100 are relatively large, such that the restoring force of the boat main body 100 is increased.

These can be summed up by the following equations.

$$F1<F2,2)F1'<F2',3)\theta1>\theta2,4)\theta1'>\theta2' \quad 1)$$

The tube connection member 300 will be described. The tube connection member 300 is a portion coupled to communicate with front end openings of the rolling reduction tubes 200 and 200' and may have a water injection hole 310, through which water is injected, formed to pass through an upper side.

The tube connection member 300 may be configured by including a water injection guide member 320 formed at an inner lower side of the tube connection member 300, formed in a curved shape that is convex upward, and configured to guide water, injected into the tube connection member 300 through the water injection hole 310, to flow downward into the rolling reduction tubes 200 and 200' (see FIG. 6).

By the water injection guide member 320, not only the injection of water into the rolling reduction tubes 200 and 200' is guided, but also external leakage of water injected into the rolling reduction tubes 200 and 200' may be prevented.

The water injection member 400 will be described. The water injection member 400 is a portion formed at a lower portion of a front side of the boat main body 100 to inject water into the water injection hole 310 and may have a plate shape and extend forward.

The water injection member 400 is submerged in water when the boat main body 100 is disposed on water and is used by a passenger 1 of the boat main body 100 to scoop water and inject the water into the water injection hole 310 of the tube connection member 300 (see FIGS. 9 and 10).

FIG. 9 is a cross-sectional view along line C-C' of FIG. 1 and shows a state before a passenger scoops and pours water using a water injection member, and FIG. is a cross-sectional view along line C-C' of FIG. 1 and shows a state in which the passenger scoops and pours water using the water injection member.

The water injection member 400 may have a bendable material to allow the passenger 1 to easily inject water.

The water injection member 400 may be configured by including a coupling hole 410 formed to vertically pass through a front end of the water injection member 400 and configured to be coupled to the coupling protrusion 500 when the water injection member 400 is rolled upward.

The coupling protrusion 500 will be described. The coupling protrusion 500 is a portion formed on an upper portion of the front side of the boat main body 100 and configured to protrude forward and is a portion coupled to the above-described coupling hole 410 (see FIGS. 4 and 5).

FIG. 4 is a lateral view of the rolling reduction boat according to the present disclosure and shows a state before a water injection member is coupled to a coupling protrusion, and FIG. 5 is a lateral view of the rolling reduction boat according to the present disclosure and shows a state after the water injection member is coupled to the coupling protrusion.

That is, by coupling the coupling hole 410 to the coupling protrusion 500 to bring the water injection member 400 in close contact with the boat main body 100, external leakage of water injected into the rolling reduction tubes 200 and 200' is prevented.

The extension member 600 will be described. The extension member 600 is a portion configured to extend vertically downward from a lower end of the front side of the boat main body 100 and submerge in water when the boat main body 100 is disposed on water. The extension member 600 serves to connect the boat main body 100 and the pitching prevention member 700, which will be described below, to each other.

The rope ladder 800 will be described. The rope ladder 800 is a portion formed at a rear side of the boat main body 100 and is a portion used by the passenger 1 to climb up to get on the boat main body 100.

The pitching prevention member 700 will be described. The pitching prevention member 700 is a portion formed on a lower end portion of the extension member 600 and formed to be dustpan-shaped with an open front surface and an open upper surface.

When the passenger 1 climbs up the rope ladder 800 to get on the boat main body 100, the boat main body 100 is pitched due to the weight of the passenger 1, and the bow of the boat main body 100 is lifted. The pitching prevention member 700 is provided to reduce such a pitching phenomenon.

Specifically, the pitching prevention member 700 is submerged in water when the boat main body 100 is disposed on water, and when the passenger 1 climbs up the rope ladder 800, as illustrated in FIG. 11, a downward force F3 acts on the stern due to the weight of the passenger 1, and corresponding to the downward force F3, an upward force F3' acts on the bow such that the bow is lifted above the water surface.

Here, the pitching prevention member 700 is also lifted. Because the pitching prevention member 700 is formed to be dustpan-shaped, the pitching prevention member 700 is lifted while filled with water, a downward force F4 acts on the bow due to the weight of the water with which the pitching prevention member 700 is filled, and corresponding to the downward force F4, an upward force F4' acts on the stern.

That is, referring to FIG. 11, the net force of the downward force F3 acting on the stern is reduced due to the upward force F4' acting on the stern in the opposite direction, and thus the pitching phenomenon can be reduced.

Likewise, the net force of the downward force F4 acting on the bow is reduced due to the upward force F3' acting on the bow in the opposite direction.

The pitching prevention member 700 may be formed of the same material as the boat main body 100 but is not necessarily limited thereto.

The present disclosure described above is not limited by the above-described embodiments and the accompanying drawings, and it should be apparent to those of ordinary skill in the art to which the present disclosure pertains that various substitutions, modifications, and changes are possible within the scope not departing from the technical spirit of the present disclosure.

INDUSTRIAL APPLICABILITY

The present disclosure relates to a boat having a rolling reduction function that reduces rolling and makes it very easy to get on the boat in water. By filling a rolling reduction tube, which surrounds a boat main body, with water during sailing of the boat, the overall weight of the boat can be increased, and the center of mass can be moved downward and distributed.

The invention claimed is:

1. A rolling reduction boat comprising:

a boat main body (100);

rolling reduction tubes (200, 200') formed to surround a side portion of the boat main body (100);

a tube connection member (300) coupled to communicate with front end openings of the rolling reduction tubes (200, 200') and having a water injection hole (310), through which water is injected, formed to pass through an upper side; and a water injection member (400) formed at a lower portion of a front side of the boat main body (100) to inject water into the water injection hole (310).

2. The rolling reduction boat of claim 1, further comprising a coupling protrusion (500) formed on an upper portion of the front side of the boat main body (100) and configured to protrude forward, wherein the water injection member (400) includes a coupling hole (410) formed to vertically pass through a front end of the water injection member (400) and configured to be coupled to the coupling protrusion (500) when the water injection member (400) is rolled upward.

3. A rolling reduction boat comprising:

a boat main body (100);

rolling reduction tubes (200, 200') formed to surround a side portion of the boat main body (100);

a tube connection member (300) coupled to communicate with front end openings of the rolling reduction tubes (200, 200') and having a water injection hole (310), through which water is injected, formed to pass through an upper side;

a water injection member (400) formed at a lower portion of a front side of the boat main body (100) to inject water into the water injection hole (310), having a plate shape, extending forward, having a bendable material, and configured to submerge in water when the boat main body (100) is disposed on water;

a coupling protrusion (500) formed on an upper portion of the front side of the boat main body (100) and configured to protrude forward;

an extension member (600) configured to extend vertically downward from a lower end of the front side of the boat main body (100) and submerge in water when the boat main body (100) is disposed on water;

a pitching prevention member (700) formed on a lower end portion of the extension member (600) and formed to be dustpan-shaped with an open front surface and an open upper surface; and a rope ladder (800) formed at a rear side of the boat main body (100), wherein the rolling reduction tubes (200, 200') include opening maintenance members (210, 210') formed to surround the front end openings of the rolling reduction tubes (200, 200') to maintain an open state of the rolling reduction tubes (200, 200'), the tube connection member (300) includes a water injection guide member (320) formed at an inner lower side of the tube connection member (300), formed in a curved shape that is convex upward, and configured to guide water, injected into the tube connection member (300) through the water injection hole (310), to flow downward into the rolling reduction tubes (200, 200'), and the water injection member (400) includes a coupling hole (410) formed to vertically pass through a front end of the water injection member (400) and configured to be coupled to the coupling protrusion (500) when the water injection member (400) is rolled upward.

* * * * *